US006703610B2

(12) United States Patent
Mordehai

(10) Patent No.: US 6,703,610 B2
(45) Date of Patent: Mar. 9, 2004

(54) SKIMMER FOR MASS SPECTROMETRY

(75) Inventor: Alex Mordehai, Santa Clara, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 59 days.

(21) Appl. No.: 10/061,465

(22) Filed: Feb. 1, 2002

(65) Prior Publication Data

US 2003/0146378 A1 Aug. 7, 2003

(51) Int. Cl.[7] ..... H01J 40/00
(52) U.S. Cl. ..... 250/288
(58) Field of Search ..... 250/288, 287, 250/282; 428/11

(56) References Cited

U.S. PATENT DOCUMENTS 4,845,367 A 7/1989 Amirav et al.
4,886,966 A * 12/1989 Matsunaga et al. ..... 250/288
5,005,678 A 4/1991 Julien et al.
5,223,131 A 6/1993 Apffel, Jr. et al.
5,304,798 A 4/1994 Tomany et al.
5,306,910 A 4/1994 Jarrell et al.
5,352,983 A 10/1994 Eriksson et al.
5,436,446 A 7/1995 Jarrell et al.
5,625,185 A 4/1997 Laser
5,793,039 A 8/1998 Oishi et al.
5,796,100 A 8/1998 Palermo
5,977,541 A 11/1999 Miyazawa et al.
5,994,697 A 11/1999 Kato
6,011,259 A 1/2000 Whitehouse et al.
6,020,586 A 2/2000 Dresch et al.
6,037,587 A 3/2000 Dowell et al.
6,057,545 A 5/2000 Sugiyama
6,136,768 A 10/2000 Dawson et al.
6,248,998 B1 6/2001 Okumoto et al.
6,297,499 B1 10/2001 Fenn
6,464,866 B2 * 10/2002 Moon et al. ..... 210/198.2
6,482,476 B1 * 11/2002 Liu ..... 427/535
6,514,620 B1 * 2/2003 Lingle et al. ..... 428/428

* cited by examiner

*Primary Examiner*—John R. Lee
*Assistant Examiner*—Phillip A Johnston
(74) *Attorney, Agent, or Firm*—Timothy H. Joyce

(57) ABSTRACT

The present invention relates to a method and apparatus for a mass spectrometer. The skimmer of the present invention has a surface to reduce the overall interaction and deposition of unwanted compounds. The surface of the skimmer may be formed from an inorganic conductive nitride or may be applied to a substrate as a coating. The invention also includes a method for reducing the interaction or deposition of compounds on a mass spectrometer skimmer by application or coating the skimmer with an inert conductive material.

18 Claims, 6 Drawing Sheets

SKIMMER FOR MASS SPECTROMETRY

TECHNICAL FIELD

This invention relates generally to the field of mass spectrometry and more particularly toward a skimmer having a surface for reduced deposition of unwanted samples, compounds or contaminants.

BACKGROUND

There are many types of ionization sources that are useful in mass spectrometry (hereinafter referred to as MS). Types of ionization sources include, but are not limited to, electron impact, chemical ionization, plasma, fast ion or atom bombardment, field desorption, laser desorption, plasma desorption, inductively coupled plasma, thermospray and electrospray. Two of the most widely used ionization sources for gaseous analytes are the electron impact (hereinafter referred to as EI) and chemical ionization (hereinafter referred to as CI). Some of these sources have been developed that produce similar ions and results under standard atmospheric pressure conditions. Atmospheric pressure ionization (API) has, therefore, been adopted for use with mass spectrometers. Each of these sources, however, has the common problem of compound deposition due to interaction or bombardment with the internal surfaces of chambers, components and conduits used in transporting ions from the ion source to the detector. More importantly, reactive samples provide an even bigger interaction or deposition problem as they are moved from ion source to detector and contact the inner surfaces of the mass spectrometer. Such reactive species include, but are not limited to trifluoroacetic acid, nitric acid, phosphoric acid, formic acid, ammonium acetate buffers and phosphate buffers. A number of attempts have been made to lower interaction of analyte and solvent with mass spectrometer parts. For example, mass spectrometer parts have been made with electropolished stainless steel surfaces in efforts to reduce the total active surface area. However, mass spectrometers using such parts were found to give variable results and still exhibit deposition of the analyte over time.

Further attempts have been made to focus changes in materials for ionization chambers and ion sources. For instance, U.S. Pat. No. 5,055,678 to Taylor et al. describes the use of a chromium or oxidized chromium surface in a sample analyzing and ionizing apparatus, such as an ion trap or El ionization chamber, to prevent degradation or decomposition of a sample in contact with the surface. This reference also describes coating the inner surface of the ionization chamber with materials known for corrosion resistance or inertness, such as gold, nickel and rhodium. Such surfaces suffer from a variety of drawbacks such as susceptibility to scratching when the metal coating is soft or assembly/diassembly difficulties when the coating has a high coefficient of friction. U.S. Pat. No. 5,796,100 to Palermo discloses a quadrupole ion trap having inner surfaces formed from molybdenum. In addition, U.S. Pat. No. 6,037,587 to Dowell et al. describes a mass spectrometer having a CI source containing a chemical ionization chamber having inner surfaces formed from molybdenum.

Others have attempted to prevent degradation problems by treating the inner metal surfaces of the analytical apparatus with a passivating agent to mask or destroy active surface sites. For example, alkylchlorosilanes and other silanizing agents have been used to treat injectors, chromatographic columns, transfer lines and detectors in GC.

See, e.g., U.S. Pat. No. 4,999,162 to Wells et al. Such treatments have been successful in deactivating metal surfaces and thus have prevented degradation of some species of analyte. Unfortunately, the materials used for such treatments have a sufficiently high vapor pressure to introduce organic materials in the gas phase within the volume of the ionization chamber that are ionized along with the analyte, producing a high chemical background in the mass spectrum.

In the field of atmospheric pressure ionization mass spectrometry it is common to separate ions or plasma from an atmospheric pressure region into a differentially pumped mass spectrometry system with an apparatus such as a skimmer installed between a first and second vacuum chamber. It is important for these devices to employ skimmers for separating compounds without interacting with them. In other words these devices should be designed to be inert to the compounds that pass through or contact their surfaces. Common skimmers are machined out of materials such as stainless steel. These devices are durable, expensive and are often damaged during abrasive cleaning.

Thus, there is a need to reduce deposition of contaminants, solvents and unwanted compounds onto mass spectrometer skimmers and their surfaces. There is also a need for skimmers that can be readily cleaned without damage to their surfaces.

SUMMARY OF THE INVENTION

The present invention relates to an apparatus and method for use with a mass spectrometer or MS system for ionizing a fluid sample. The skimmer of the present invention has a surface for reducing interaction with compounds and comprises a surface having an inorganic, conductive nitride compound. The nitride compound may be, for example, a titanium nitride or a mixed metal nitride such as an aluminum-titanium nitride or titanium-carbon-nitride.

The invention also provides a method of reducing interaction or deposition of a compound with a surface of a mass spectrometer skimmer, the method comprises applying a coating selected from the group consisting of nitrides of metals to the surface of the skimmer.

BRIEF DESCRIPTION OF THE FIGURES

The invention is described in detail below with reference to the following figure.

DETAILED DESCRIPTION OF THE INVENTION

Figure 1:
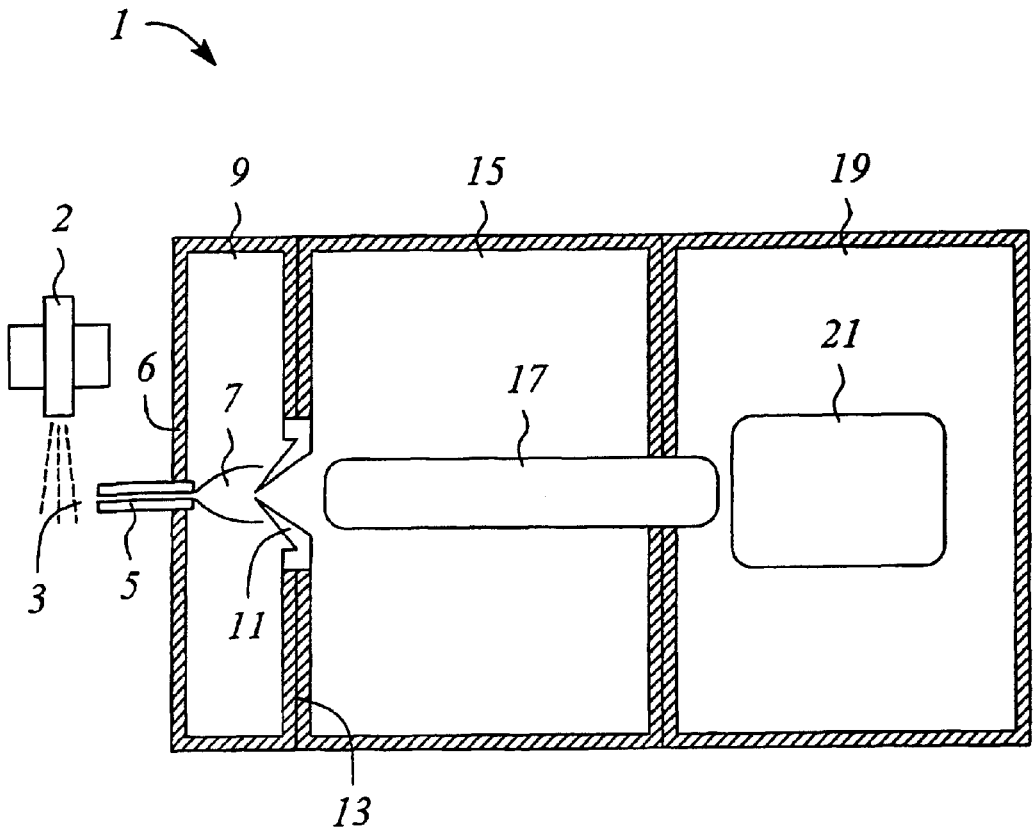
FIG. 1 shows a general system diagram of the present invention.
Figure 2:
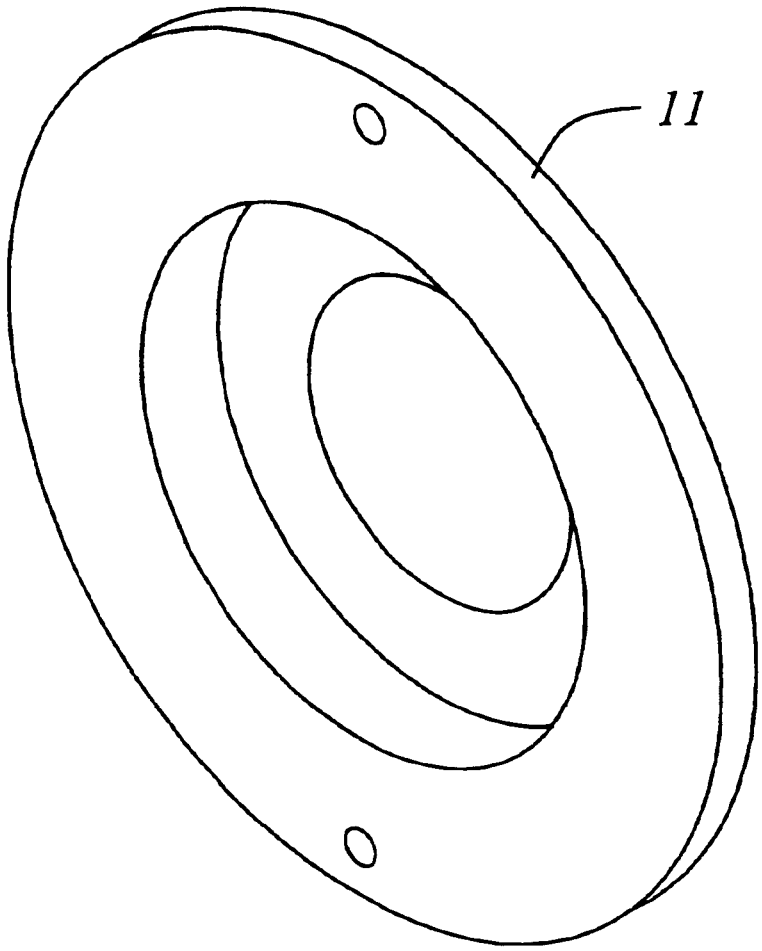
FIG. 2 shows a perspective view of the present invention.

Before describing the invention in detail, it must be noted that, as used in this specification and the appended claims, the singular forms "a," "an," and "the" include plural referents unless the context clearly dictates otherwise. Thus, for example, reference to "a material" includes combinations of materials, reference to "a compound" includes admixtures of compounds, reference to "a nitride" includes a plurality of nitrides, and the like.

In describing and claiming the present invention, the following terminology will be used in accordance with the definitions set out below.

The term "skimmer" is used herein to refer to any structure placed between an ion source and ion detector that is used to separate regions of flow with low disruption. Separation includes any structure or technique that separates based on structural design and is not based on ion optics, ion charge or use of an applied electric field. A "skimmer" may comprise any number of shapes and designs that may intercept jet expansion advantageously.

The term "surface" as used herein refers to any surface of a skimmer that can be subject to undesirable interaction with a compound. The term encompasses surfaces of a component that may not be a part of the skimmer, but are used in conjunction with the skimmer. The term should be construed broadly to include portions of surfaces as well as more than one surface. Surfaces may or may not be contiguous.

The term "nitride compound" is used in its conventional sense and refers to a compound containing nitrogen and at least one more electropositive elements. Typically, nitrides exhibit a high degree of hardness and may have a wurtzite-like microstructure.

The term "resistivity" is used in its conventional sense and refers to a material's opposition to the flow of electric current. Unless otherwise specified, resistivity is measured in ohm-cm and is the inverse of "conductivity" which is measured in siemens/cm. A material's resistivity may vary according to temperature, and unless otherwise specified, resistivity is measured at room temperature. Semiconductors are considered to be relatively nonconductive at room temperature and at normal temperatures of operation of ion sources (<300° C.).

The term "metallic" as used herein refers to a material that has a low resistivity (less than $10^{-1}$ or 0.1 ohm-cm), that exhibits hardness and resistance to abrasion in thin film form, and that is inert toward the compounds described below. In particular, metallics are distinguished from insulators and ordinary semiconductors, which have resistivities much greater than $10^{1}$ or 10.0 ohm-cm. Metallics are further distinguished from pure metals, such as chromium, tungsten, iron, gold, molybdenum and their oxides, and compounds containing metalloids such as silicon nitride and nonmetals such as boron nitride.

The invention is described herein with reference to the figures. The figures are not to scale, and in particular, certain dimensions may be exaggerated for clarity of presentation.

FIGS. 1–3A shows an application of the present invention. Although the figures illustrate an API source, the invention should not be construed narrowly to include only this particular source and system and can be applied to other sources known in the art.

Figure 3A:
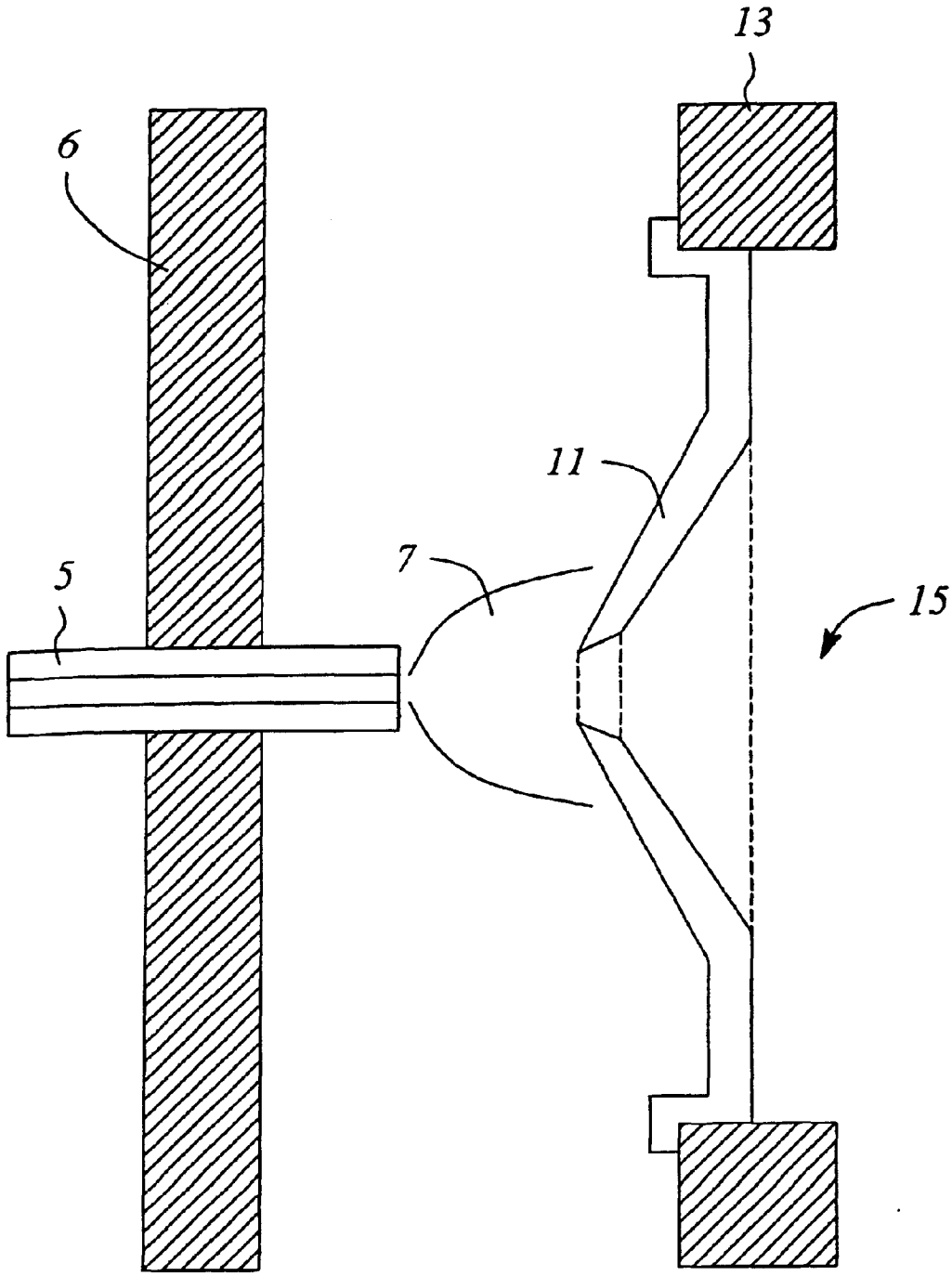
FIG. 3A shows a first embodiment of the present invention.

Referring now to FIGS. 1–3A, the mass spectrometer 1 of the present invention includes a first vacuum chamber 9, second vacuum chamber 15 and third vacuum chamber 19. Although three vacuum chambers are shown in the diagram, other chambers may be used with the present invention. An ionized sample 3 is produced by the ion source 2 (shown as an atmospheric pressure ionizer in an orthogonal arrangement) and then collected by a sampling capillary 5. Sampling capillary 5 is positioned in first chamber wall 6 and connects the ion source 2 to the first vacuum chamber 9. The skimmer 11 of the present invention is employed between first vacuum chamber 9 and second vacuum chamber 15. It should be noted that skimmer 11 may be used in a wide variety of positions along the ion path of mass spectrometer 1 that may require compound separation. Skimmer 11 is shown in FIG. 1 and FIG. 3A and illustrates how the apparatus is used with an aerodynamic jet 7 produced from sampling capillary 5. Downstream of the skimmer 11 are ion transfer optics 17 which are employed for moving the ionized sample 3 to the third vacuum chamber 19 and mass analyzer 21. As mentioned, a number of applications are possible with the skimmer 11 of the present invention. FIGS. 3(A)–(G) show a number of systems that the invention may be employed with. A limited number of examples are shown for illustrative purposes only. Other combinations, systems and embodiments are possible with the present invention that are well known in the art.

Figure 3B:
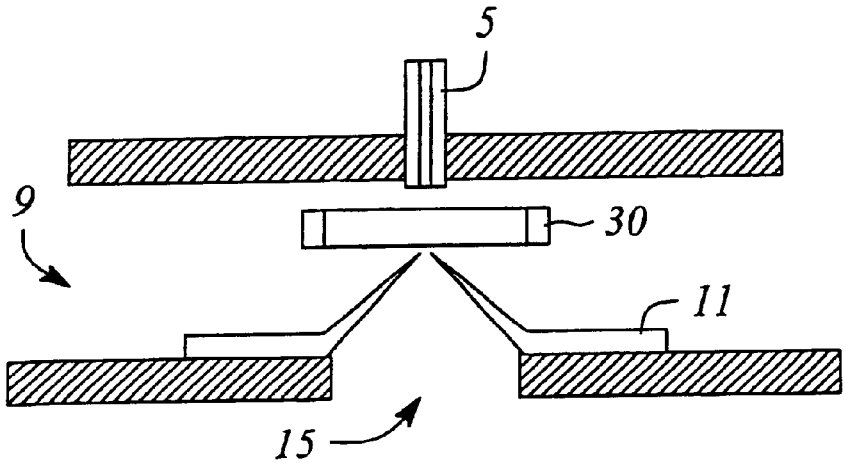
FIG. 3B shows a second embodiment of the present invention.

FIG. 3(B) shows a second embodiment of the present invention. The figure illustrates an off axis introduction system and API mass spectrometer with additional focusing electrode 30. The skimmer 11 of the present invention is positioned in first vacuum chamber 9 between sampling capillary 5 and second vacuum chamber 15. A focusing electrode 30, however, is employed between sampling capillary 5 and skimmer 11. The skimmer 11 shown in each of the embodiments (FIGS. 3A–3G) of the invention comprises a material selected from the group consisting of nitrides of metals. More description of the material and its application as a coating is provided below.

Figure 3C:
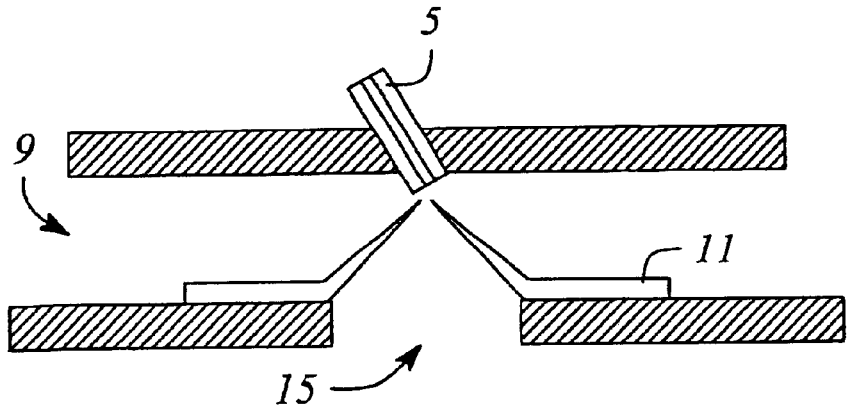
FIG. 3C shows a third embodiment of the present invention.

FIG. 3(C) shows a third embodiment of the present invention. The diagram illustrates an angular sample introduction system into an API mass spectrometer. This embodiment of the present invention is similar to the embodiment shown in FIG. 3(A), but the sampling capillary 5 is at an angle to skimmer 11.

Figure 3D:
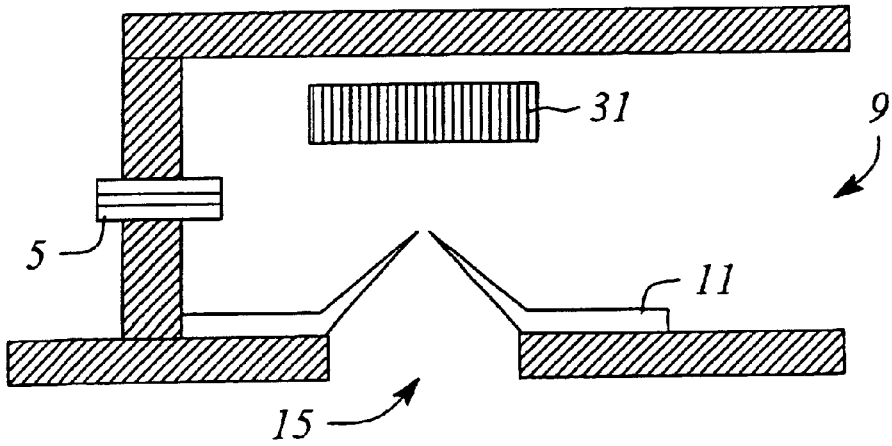
FIG. 3D shows a fourth embodiment of the present invention.

FIG. 3(D) shows a fourth embodiment of the present invention. This figure illustrates a sample introduction system into an API mass spectrometer with 90 degree deflection. Skimmer 11 is employed again in first vacuum chamber 9 upstream of second vacuum chamber 15. However, the sampling capillary 5 is positioned in an orthogonal orientation relative to skimmer 11. A deflecting electrode 31 is used for deflecting ions toward skimmer 11.

Figure 3E:
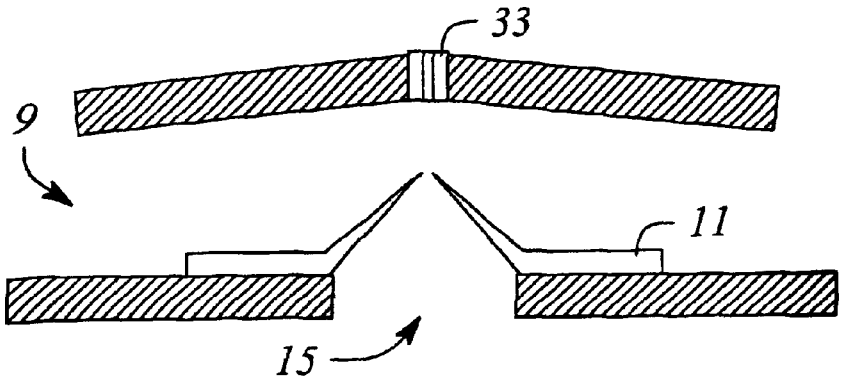
FIG. 3E shows a fifth embodiment of the present invention.

FIG. 3(E) shows a fifth embodiment of the present invention. The figure shows a sample introduction system into an API mass spectrometer through a sampling nozzle. This embodiment of the invention is similar to the embodiments shown in FIGS. 3(A)–(D), but employs sampling nozzle 33. Sampling nozzle 33 is employed in place of sampling capillary 5.

Figure 3F:
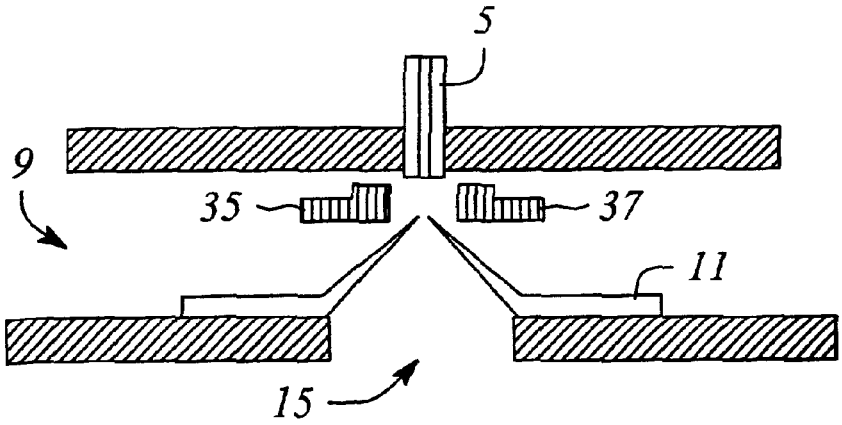
FIG. 3F shows a sixth embodiment of the present invention.

FIG. 3(F) shows a sixth embodiment of the present invention. The diagram shows a sample introduction system into API mass spectrometer with an additional ionization in the first vacuum chamber. The figure shows a similar system as discussed above, but includes the use of glow discharge electrodes 35 and 37.

Figure 3G:
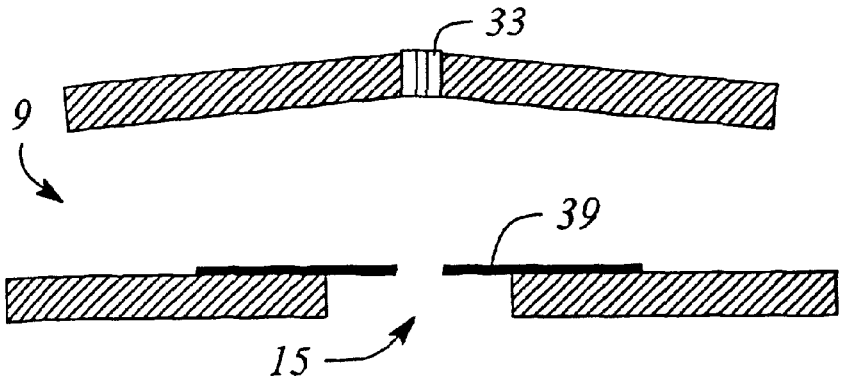
FIG. 3G shows a seventh embodiment of the present invention.

FIG. 3(G) shows a seventh embodiment of the present invention. The system shows an API mass spectrometer with a sampling nozzle 33 as described in the fifth embodiment of the invention (described above and shown in FIG. 3(E)). Skimmer 39 is a flat skimmer.

Figure 4A:
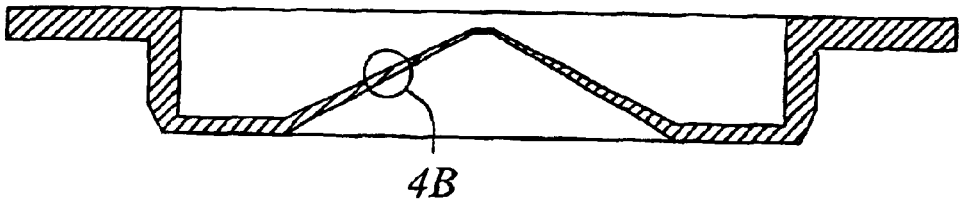
FIG. 4A shows a cross-sectional view of the present invention.
Figure 4B:
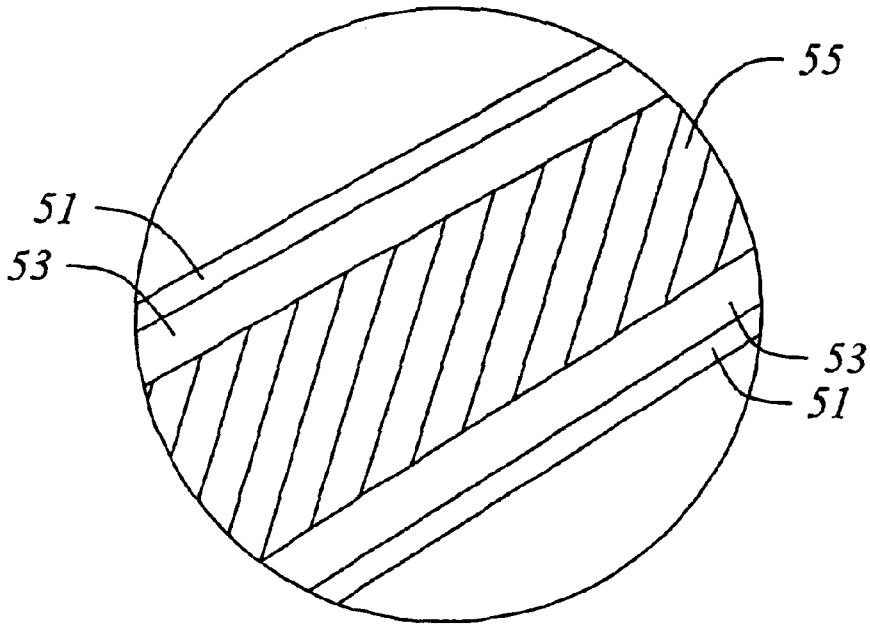
FIG. 4B shows a magnified portion of FIG. 4B.

FIG. 4(A) shows a cross sectional view of the present invention. FIG. 4(B) is a magnified area of a portion of FIG. 4(A). FIGS. 4A and 4B show the composition of the skimmer and each of the surfaces and layers employed in the invention. The skimmer 11 of the present invention may comprise a titanium nitride material or may be applied as a coating. FIG. 4B shows a titanium nitride surface 51 applied on a nickel layer 53 and substrate layer 55. Substrate layer 55 may comprise an aluminum material. Other layers and materials may be employed with the present invention. However, it is important to the invention that the nitride surface or layer be on the exterior of skimmer 11 to reduce interaction or deposition of compounds. Inorganic, conductive nitride compounds unexpectedly render surfaces of skimmer 11 more inert with respect to certain known reactive compounds than typical chamber surface materials such as stainless steel, gold, nickel, chromium and chromium oxides, fused silica, aluminum oxide and molybdenum. Those reactive species include, but are not limited to, trifluoroacetic acid, nitric acid, phosphoric acid, formic acid, ammonium acetate buffers and phosphate buffers. The conductive nitride compound may be a titanium nitride, or a mixed metal nitride such as an aluminum-titanium nitride. Titanium nitride exhibits exceptionally inert properties with respect to many such analytes. Other nitrides include, but are not limited to, titanium carbon nitride, titanium aluminum nitride, aluminum titanium nitride, chromium nitride, zirconium nitride and tungsten nitride. In addition, nitrides in general exhibit other properties that are particularly beneficial for mass spectrometry applications. For example, nitrides when coated on surfaces of a skimmer are extremely hard and allow parts coated therewith to be cleaned using relatively hard abrasives. Nitrides of the present invention exhibit hardness greater than about 2000 kg/mm Knoop or Vicker Microhardness, typically about 2500 to about 3500. This translates to about 85 Rc. In addition, some nitrides exhibit microstructural polymorphism that may or may not depend on the stoichiometry of the compound. Polymorphism may be the result of how the compound is formed.

If the skimmer is coated with a dielectric, static charge will accumulate on the skimmer over time. Such charging will cause arcing resulting in a false signal, or such charge distribution may distort the field, thereby altering the ability of the skimmer to separate compounds. Thus, if an inert coating is employed on any surface of the skimmer, it is preferred that the coating be sufficiently electrically conductive to allow dissipation of charge, as discussed below. Materials having a lower resistivity may be deposited in a thicker coating on a surface of the skimmer. Irrespective of the resistivity of the coating, the coating should be uniformly deposited to insure that there are no uncoated areas or pinholes as well as to provide sufficient coverage to mask active sites on the surface.

In addition to unexpected inertness toward certain important reactive substances, the compounds disclosed herein for use on skimmer surfaces have certain other advantages. These compounds, having electrical resistivities no greater than about $10^{-1}$ ohm-cm, preferably no greater than about $10^{-3}$ ohm-cm, provide a conductive surface that resists charging by ion bombardment more than materials with higher resistivity. In particular, it is known that when typical insulating or semiconducting materials are used to provide a coating for skimmer surfaces, such coatings usually cannot exceed about a thousand angstroms before an undesirable degree of electrical charging occurs due to accumulation of ions on the surface of the coating. The optimum thickness for avoiding charging is less than about two hundred angstroms. However, it is generally difficult to provide uniform coverage of a thin film coating over a surface; typically, thin coatings can contain pinholes or areas that are too thin to mask the reactive properties of the surface beneath the coating. Moreover, even if uniform coverage of a thin film is possible, thin films are less scratch resistant than thick films. Conducting films can be applied in any thickness without danger of charging, thus, conducting films are preferred over thin non-conducting films. In addition, since nitride compounds are harder than most metals, coatings of the present invention resist scratching better than metals and alloys that also exhibit low electrical resistivity. As an aside, for some ionic films deposited on a substrate surface, e.g., titanium nitride on a metal substrate, it has been observed that the hardness of the film depends on the hardness of the substrate.

Many ionic compounds do not exhibit electrical resistivity lower than about 10 ohm-cm. Typical ionic compounds, e.g., aluminum oxide, silicon nitrides and boron nitride, exhibit an electrical resistivity greater than about $10^{13}$ ohm-cm. Examples of metal nitrides with low resistivity include, but are not limited to, titanium nitride, zirconium nitride, chromium nitride and mixed-metal nitrides such as an aluminum-doped titanium nitride. In some conductive ionic materials, stoichiometry and microstructure can greatly affect the resistivity. However, one of ordinary skill in the art, through routine experimentation, can determine the optimum stoichiometry for any of the conductive compounds of the present invention, which can be produced using any of a number of techniques as disclosed herein. Preferably, the coating consists essentially of a nitride compound with low resistivity as disclosed above.

There are many methods that can be employed to coat the compounds of the present invention onto the surface of the skimmer. One method involves a two-step process: depositing a thin layer of a metal or alloy on the surface of interest and exposing the surface to an appropriate element under reaction conditions effective to form the desired compound. There are many ways in which a thin layer of metal can be deposited, e.g., by evaporation, sputtering, electroplating, chemical vapor deposition (CVD), physical vapor deposition (PVD), etc, as is known in the art. It is notable, though, that not all methods of metallic layer deposition can be employed with ease for any particular metal. For example, a metal with a low melting point or boiling point temperature is particularly suitable for deposition through evaporation. Conversely, metals with a high melting point such as tungsten are not easily deposited through evaporation. Once a layer of metal is deposited, the layer can be exposed to a source of an appropriate electronegative element under suitable conditions to form the desired compound. For example, metal layer surfaces may be exposed to glow discharge plasma. With nitrides, a substrate having a metal layer surface is placed in a vacuum chamber. Then, ionized nitrogen gas is combined with other gases and a high voltage is applied to strike a glow to react with the substrate. It is evident that proper film formation conditions may involve high temperature processing; therefore, the material on which the surface is to be converted must be able to withstand all processing conditions. In addition, conversion of a metal layer into a compound of the present invention depends on the diffusion rate of the negatively charged species into the metal layer, and such conversion may be inefficient for some compounds of the present invention.

Alternatively, the compounds of the present invention may be deposited on the surface in vacuum processes that do not involve two discrete steps as described above. Such vacuum processes include, but are not limited to, cathodic arc PVD, electron-beam evaporation, enhanced arc PVD, CVD, magnetronic sputtering, molecular beam epitaxy, combinations of such techniques and a variety of other techniques known to one of ordinary skill in the art. One of ordinary skill in the art will recognize that CVD usually involves heating a substrate surface to a sufficiently high temperature to decompose gaseous organic species to form the desired film. Such heating usually precludes the use of plastic as a surface on which the film is deposited. PVD, on the other hand, does not necessarily exclude plastics as a substrate and allows for masked film deposition. However, the method coats only surfaces that are within the "line of sight" of the source of the coating material, and "blind" spots are not coated. In addition, some substrate heating may be employed in physical vapor deposition to promote film adhesion.

In the case of titanium nitride, hollow cathode discharge ion plating has been widely used. This method involves depositing titanium in the presence of nitrogen gas as a reactive gas. In hollow cathode discharge ion plating, dense films can be formed as titanium molecules are evaporated while nitrogen gas is introduced. Care must be taken, however, to ensure optimal deposition. If energy in the process is too low, the evaporated titanium does not react with the nitrogen and the resultant film does not adhere well to the surface. On the other hand, excessive energy results in re-evaporation from the substrate or damages to the surface.

The highly conductive surface of the invention can be provided using the above methods. As discussed above, the coating of the highly conductive material is thicker than ordinary semiconductor or insulator coatings. Generally, the coating of the invention can be deposited having a thickness from about 1000 angstroms to about 10 microns. Thicknesses achieved with PVD are normally about 0.5 to about 2 microns, and CVD processes normally result in thicknesses of about 2 to about 5 microns. It is notable that adhesion between the compound of the present invention and the surface tends to be of marginal quality at very high thicknesses. In addition, differences in thermal expansion coefficient between the coating layer and the surface on which the coating is deposited can also contribute to adhesion problems if the surfaces are subject to drastic changes in temperature.

The particular coating technique used generally affects the microstructure, morphology, and other physical characteristics of the deposited material. In addition, when the aforementioned deposition techniques are employed, variations in processing parameters can substantially change the morphology of the deposited film. In general, it is desirable to produce a smooth film of generally uniform thickness. Smooth films tend to provide a lower surface area, thereby rendering the film kinetically unfavorable for reaction with analytes. Smoothness of the film will, however, be highly dependent on, and in general determined by, the smoothness of the underlying surface.

As another alternative, the surface coating material can be applied as a powder. One method of powder application involves providing the conductive compound in powdered form and employing high pressure to spray the powder entrained in a fluid at high velocity such that the powder mechanically adheres to the surface. Another method involves suspending the powder in a solvent to form a paint, applying the paint onto the surface, and evaporating the solvent. The solvent can be a relatively inert carrier or one that facilitates chemical bonding between the powder particles or between the powder and the surface. In addition, heat can be applied to evaporate the solvent or to promote chemical bonding. Typically, no organic binder is used because organic materials generally outgas at sufficiently high vapor pressure to produce a gas phase that is ionized along with the sample, producing a high background in the mass spectrum. However, the film of the present invention does not necessarily preclude inclusion of a small amount of an organic binder if overall outgassing is sufficiently low. However, one drawback to this method is that the resulting coating does not withstand abrasive cleaning as well and may have to be reapplied over time.

Variations of the foregoing will be apparent to those of ordinary skill in the art. For example, while these coatings may be applied to surfaces composed of stainless steel, such coatings can also be applied to other surfaces such as aluminum or other structural materials that are typically used to form an ionization chamber or other components of a mass spectrometer. In addition, some compounds will be especially inert with respect to some analytes, and a particular coating may be applied to a surface that is designed for exposure to a specific analyte. For example, dinitrophenols are particularly reactive to components of conventional mass spectrometers. In contrast to the insulating and even conductive compounds used in the prior art, the conductive compounds of the invention, e.g., titanium nitride has been found to exhibit unexpected inertness with respect to dinitrophenols. Titanium nitride also exhibits unexpected inertness with respect to less reactive compounds than dinitrophenols.

It is to be understood that while the invention has been described in conjunction with the preferred specific embodiments thereof, that the foregoing description as well as the examples that follow are intended to illustrate and not limit the scope of the invention. Other aspects, advantages and modifications within the scope of the invention will be apparent to those skilled in the art to which the invention pertains.

All patents, patent applications, and publications mentioned herein are hereby incorporated by reference in their entireties.

EXAMPLE 1

A freshly cleaned standard aluminum nickel-plated skimmer was provided in a first vacuum region of an ion trap mass spectrometer made by Agilent Technologies. The mass spectrometer was utilized to perform various chemical analyses in the lab for a one-year period. The chemical analysis included analysis of peptides and proteins in the TFA buffers, analyses of variety of pharmaceutical drugs in ammonium formate as well as phosphate buffers. After one year of operation the skimmer was removed for inspection and clean up. The skimmer had a black area about 4 mm in radius of deposits centered around the skimmer aperture. It was impossible to remove the deposit chemically without destroying the nickel layer. The deposit had to be removed mechanically using extremely fine sandpaper.

EXAMPLE 2

A skimmer with titanium nitride coating over the standard aluminum nickel-plated skimmer was provided in a first vacuum region of an ion trap mass spectrometer made by Agilent Technologies. Similar to the example one the mass spectrometer was utilized to perform various chemical analyses in the lab for the one-year period. The chemical analysis included analysis of peptides and proteins in the TFA buffers, analyses of variety of pharmaceutical drugs in ammonium formate as well as phosphate buffers. After one year of operation the skimmer was removed for inspection and clean up. The skimmer had a gray area about 2 mm in radius of deposits centered around the skimmer aperture. It was possible to remove the deposits chemically by applying using a swab with a 10% solution of phosphoric acid, deionized water and methanol without damaging the skimmer. This indicates that the titanium nitride surface is less subjected to contamination with respect to the analyzed samples and can be easily cleaned chemically without applying mechanical treatment.

What is claimed is:

1. A skimmer for use with a mass spectrometer, said skimmer having a surface comprising an inorganic conductive material selected from the group consisting of nitrides of metals.

2. A slimmer as recited in claim 1, wherein said group consists of titanium nitride, titanium aluminum nitride, aluminum titanium nitride, titanium carbon nitride, chromium nitride, zirconium nitride, tungsten nitride, aluminum doped titanium nitride, molybdenum nitride, niobium nitride, and vanadium nitride.

3. A skimmer as recited in claim 1, wherein said surface has a resistivity lower than 0.1 ohm-cm.

4. A skimmer as recited in claim 1, wherein said surface has a resistivity lower than 0.01 ohm-cm.

5. A skimmer as recited in claim 1, wherein said surface has a resistivity lower than 0.001 ohm-cm.

6. A skimmer as recited in claim 1, wherein said surface is an outer surface of a coating.

7. A skimmer as recited in claim 6, additionally comprising an electrically-conducting substrate positioned to support said coating.

8. A skimmer as recited in claim 6, wherein said surface has a resistivity lower than 0.1 ohm-cm.

9. A skimmer as recited in claim 6, wherein said surface has a resistivity lower than 0.01 ohm-cm.

10. A skimmer as recited in claim 6, wherein said surface has a resistivity lower than 0.001 ohm-cm.

11. A skimmer having a coated surface for reduced interaction with compounds, wherein said coated surface comprises an abrasion-resistant metallic of thickness greater than 0.1 micron.

12. A skimmer as recited in claim 11, wherein said thickness is also less than about 10 microns.

13. A skimmer as recited in claim 11, wherein said surface has a hardness of at least 2000 kg/mm Vickers microhardness.

14. A skimmer as recited in claim 13, wherein said hardness is also less than 3500 kg/mm Vickers microhardness.

15. A skimmer as recited in claim 11, wherein said surface hardness is about 3000 kg/mm Vickers microhardness.

16. A system for analyzing a sample having constituents, said system comprising a skimmer having a surface exposed to said constituents, said skimmer comprising an electrically-conducting substrate and a surface layer supported by said substrate, said layer including an inert inorganic material selected from the group consisting of nitrides of metals.

17. A method of reducing interaction of compounds with a surface of a skimmer, the method comprising applying a coating selected from the group consisting of nitrides of metals to the surface of the skimmer.

18. A method as recited in claim 17, wherein said surface comprises an electrically-conductive material.

* * * * *